United States Patent [19]

Rutfield

[11] Patent Number: 4,940,918

[45] Date of Patent: Jul. 10, 1990

[54] FLUORESCENT LAMP FOR LIQUID CRYSTAL BACKLIGHTING

[75] Inventor: Sharon B. Rutfield, North Chelmsford, Mass.

[73] Assignee: GTE Products Corporation, Danvers, Mass.

[21] Appl. No.: 383,494

[22] Filed: Jul. 24, 1989

[51] Int. Cl.[5] ..... H01J 1/63

[52] U.S. Cl. ..... 313/487

[58] Field of Search ..... 313/487, 485

[56] References Cited

U.S. PATENT DOCUMENTS

| | | | |
|---|---|---|---|
| 3,841,752 | 10/1974 | Terajima et al. | 355/4 |
| 3,875,453 | 4/1975 | Thornton, Jr. | 313/487 |
| 3,963,953 | 6/1976 | Thornton, Jr. | 313/487 |
| 4,176,299 | 11/1979 | Thornton, Jr. | 315/326 |
| 4,208,448 | 6/1980 | Panaccione | 313/487 X |
| 4,296,353 | 10/1981 | Walter | 313/487 |
| 4,664,481 | 5/1987 | Ito | 350/345 |
| 4,683,379 | 7/1987 | Wolff | 250/493.1 |
| 4,767,193 | 8/1988 | Ota et al. | 350/345 |

FOREIGN PATENT DOCUMENTS

| | | | |
|---|---|---|---|
| 1184966 | 4/1985 | Canada | 313/487 |

*Primary Examiner*—Sandra L. O'Shea

*Attorney, Agent, or Firm*—Carlo S. Bessone

[57] ABSTRACT

A fluorescent lamp suitable for backlighting a liquid crystal display includes a three-component phosphor disposed within the lamp envelope and responsive to the ultraviolet radiation generated by the plasma discharge in the lamp. The phosphor includes a first component having a first energy peak with a predetermined maximum intensity located within the wavelength range of from about 435 nanometers to 440 nanometers. A second component of the phosphor generates a second energy peak with a predetermined maximum intensity located within the wavelength range of from about 545 nanometers to 550 nanometers. A third component of the phosphor provides a third energy peak with a predetermined maximum intensity located within the wavelength range of from about 610 nanometers to 615 nanometers. The maximum intensity value of the first energy peak is within the range of from about 70% to 115% of the maximum intensity of the second energy peak. The maximum intensity value of the third energy peak is within the range of from about 65% to 87% of the maximum intensity of the second energy peak. The three energy peaks have bandwidths less than or equal to about 40 nanometers as measured at an intensity which is 50% of a respective maximum peak intensity. In one embodiment, the phosphor comprises a blend including about 42% to 44% by weight europium-activated strontium chlorophosphate, about 25% to 29% by weight cerium-terbium-activated magnesium aluminate and about 27% to 33% by weight europium-activated yttrium oxide.

10 Claims, 3 Drawing Sheets

FLUORESCENT LAMP FOR LIQUID CRYSTAL BACKLIGHTING

FIELD OF THE INVENTION

This invention relates in general to a fluorescent lamps and pertains, more particularly, to a fluorescent lamp suitable for liquid crystal color display backlighting applications.

BACKGROUND OF THE INVENTION

Fluorescent lamps are well known in the art and are used for a variety of types of lighting applications. Such lamps are characterized as low pressure arc discharge lamps and include an elongated envelope, whose internal surface is coated with phosphor, an electrode structure at each end of the envelope. The envelope also contains a quantity of an ionizable material, such as mercury, and a fill gas at a low pressure, for example in the order of 1–5 torr. The fill gas can be, for example argon or krypton, or a mixture of these and other gases.

When a voltage is applied across the electrodes, electrons will be emitted, ionizing the gas inside the envelope. The resultant ionization and recombination of ions and electrons produce primarily 253.7 nm. radiation which is converted by means of the phosphor into radiation of a longer wavelength and a spectral distribution, depending on the phosphor material used, in the near ultraviolet or in the visible part of the spectrum.

As stated above, one such lighting application in which fluorescent lamps are used is to provide backlighting to a liquid crystal display. Since the liquid crystal panel itself is a non-luminous element, a light source is necessary for illuminating the liquid crystal panel. The light transmissivity of the liquid crystal panel is controlled according to electrical signals given thereto so that an image corresponding to, for example, a still or moving image is displayed on the liquid crystal panel. A backlit liquid crystal display provides a suitable alternative to the traditional CRT display. When used in conjunction with a dimmable fluorescent backlight, the liquid crystal display device provides a high contrast image over a wide range of ambient light conditions, i.e., from full sunlight to complete darkness.

A typical multi-color liquid crystal display unit comprises a liquid crystal panel, a fluorescent lamp and three individual filters. The coloring is achieved by the deposition of liquid crystal filters on a light-transmissive substrate. This substrate (usually a light-transmissive plate) is typically lit from behind by a fluorescent lamp containing a standard halophosphate phosphor such as daylight. Because of the spectral power distribution from such phosphors, the gamut shape, color balance and brightness of the liquid crystal display is not optimal.

The ideal performance of a liquid crystal color filter would entail 100 percent transmission of light at either 450 nanometers, 540 nanometers or 620 nanometers and 0 percent transmission at the remaining two wavelengths. Hence, a complete display would consist of three individual filters: a blue filter (passing 450 nanometer energy), a green filter (passing 540 nanometer energy), and a red filter (passing 620 nanometer energy), and a fluorescent backlight source which would emit sharp energy peaks at 450, 540 and 620 nanometers.

Examples of fluorescent lamps for liquid crystal displays are described in U.S. Pat. Nos. 4,664,481 and 4,767,193.

SUMMARY OF THE INVENTION

It is, therefore, an object of the present invention to obviate the disadvantages of the prior art.

It is another object of the invention to provide an improved fluorescent lamp suitable for use in backlighting liquid crystal displays.

It is still another object of the invention to provide an improved fluorescent lamp having an emission spectrum which closely approximates the transmission spectrum of a typical liquid crystal filters.

These objects are accomplished in one aspect of the invention by the provision of a fluorescent lamp comprising a glass envelope having a substantially circular configuration in cross-section. Electrodes are operatively positioned proximate each end of the envelope. An ionizable medium is enclosed within the envelope and includes an inert starting gas and a quantity of mercury. The ionizable medium when energized generates a plasma discharge comprising ultraviolet radiation and a limited proportion of visible radiation. A phosphor means responsive to the ultraviolet radiation generated by the plasma discharge is disposed within the envelope and comprises a component mixture of different phosphors. A first component of the phosphor when energized by the ultraviolet radiation has a first energy peak with a predetermined maximum intensity located within the wavelength range of from about 435 nanometers to 440 nanometers. A second component of the phosphor has a second energy peak with a predetermined maximum intensity located within the wavelength range of from about 545 nanometers to 550 nanometers. A third component of the phosphor has a third energy peak with a predetermined maximum intensity located within the wavelength range of from about 610 nanometers to 615 nanometers.

The maximum intensity of the first energy peak is within the range of from about 70% to 115% of the maximum intensity value of the second energy peak and the maximum intensity of the third energy peak is within the range of from about 65% to 87% of the maximum intensity of the second energy peak. The first, second and third energy peaks have bandwidths less than or equal to about 40 nanometers as measured at an intensity which is 50% of a respective maximum intensity.

In a preferred embodiment, the first, second and third energy peaks are located respectively at 435 nanometers, 545 nanometers, and 611 nanometers.

In accordance with further aspects of the present invention, the energy within a first wavelength band located between 380 nanometers and 500 nanometers is within the range of from about 40% to 50% of the total visible energy from the lamp. Preferably, the energy within a second wavelength band located between 500 nanometers and 600 nanometers is within the range of from about 25% to 30% of the total visible energy. In a preferred embodiment, the energy within a third wavelength band located between 600 and 760 nanometers is within the range of from about 20% to 30% of the total visible energy from the lamp.

In accordance with still further teachings of the present invention, the phosphor means comprises a phosphor blend including predetermined proportions of at least europium-activated strontium chlorophosphate, cerium-terbium-activated magnesium aluminate, and europium-activated yttrium oxide. In a preferred embodiment, the phosphor blend includes about 42% to 44% by weight europium-activated strontium chlorophosphate, about 25% to 29% by weight cerium-terbium-activated magnesium aluminate, and about 27% to 33% by weight europium-activated yttrium oxide.

In accordance with further teachings of the present invention, the phosphor means comprises a phosphor blend including predetermined proportions of at least europium-activated strontium chlorophosphate, manganese-activated zinc orthosilicate, and europium-activated yttrium oxide. In a preferred embodiment, the phosphor blend includes about 43% by weight europium-activated strontium chlorophosphate, about 27% by weight manganese-activated zinc orthosilicate, and about 30% by weight europium-activated yttrium oxide.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
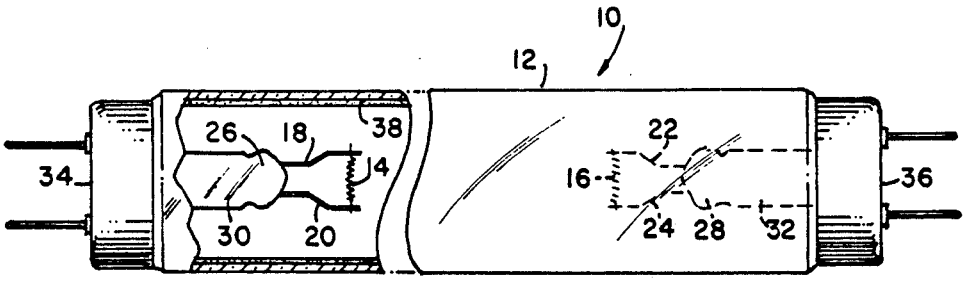
FIG. 1 represents a front elevational view, partially broken away, of a fluorescent lamp made in accordance with the teachings of the present invention.
Figure 2:
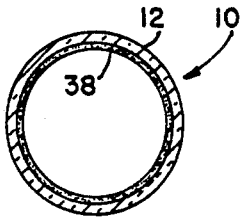
FIG. 2 is a cross-sectional view of the fluorescent lamp of FIG. 1.

Referring to the drawings with greater particularity, there is illustrated in FIGS. 1 and 2 a fluorescent lamp 10. Lamp 10 is comprised of an elongated sealed glass envelope 12 of circular cross-section made of soda-lime or lead glass. The envelope may be linear as shown in FIG. 1 or, for example, have a U-shape.

Envelope 12 encloses an ionizable medium including an inert starting gas and a quantity of mercury, at least enough to provide a low vapor pressure of about six microns during operation. The starting gas may consist of argon, neon, helium, krypton or a combination thereof at a low pressure in the range of about 1 torr to 4 torr. When energized, the ionizable medium generates a plasma discharge comprising ultraviolet radiation at 253.7 nanometers, 297 nanometers, 313 nanometers, 365 nanometers, and a limited proportion of visible radiation at 405 nanometers, 436 nanometers and 579 nanometers.

An electrode 14, 16 is operatively positioned proximate each end of envelope 12 and supported by lead-in wires 18, 20 and 22, 24, respectively. Each electrode comprises a tungsten coil coated with an emissive material of alkaline earth oxides. The lead-in wires extend through glass presses 26, 28 in mount stems 30, 32 to the contacts in bases 34, 36 affixed to the ends of envelope 12.

A phosphor means 38, responsive to the ultraviolet radiation (primarily 253.7 nanometers) generated by the plasma discharge, is disposed within the envelope and comprises at least a three-component mixture of different phosphors which generates three narrow-band peaks each having a bandwidth which is less than or equal to about 40 nanometers as measured at an intensity which is 50% of the maximum peak intensity.

The first component of the phosphor when energized by the ultraviolet radiation has a first energy peak with a predetermined maximum intensity located within the wavelength range of from about 435 nanometers to 440 nanometers. One suitable phosphor for the first component is europium-activated strontium chlorophosphate. The second of the phosphor components has a second energy peak with a predetermined maximum intensity located within the wavelength range of from about 545 nanometers to 550 nanometers. Suitable phosphors include cerium-terbium-activated magnesium aluminate and manganese-activated zinc orthosilicate. Finally, the third component of the phosphor has a third energy peak with a predetermined maximum intensity located within the wavelength range of from about 610 nanometers to 615 nanometers. One suitable phosphor for the third component is europium-activated yttrium oxide. In a preferred embodiment, the phosphor blend includes about 42% to 44% by weight europium-activated strontium chlorophosphate, about 25% to 29% by weight cerium-terbium-activated magnesium aluminate, and about 27% to 33% by weight europium-activated yttrium oxide.

According to the teachings of the invention, the maximum intensity of the first energy peak is within the range of from about 70% to 90% of the maximum intensity of the second energy peak. Moreover, the maximum intensity value of the third energy peak is within the range of from about 65% to 85% of the maximum intensity value of the second energy peak.

The total visible energy from the lamp is located substantially within three wavelength bands. The first wavelength band is between 380 nanometers and 500 nanometers, the second wavelength band between 500 nanometers and 600 nanometers, and the third wavelength band is between 600 and 760 nanometers. Ultraviolet energy below about 400 nanometers is substantially attenuated by the envelope.

The energy within the first wavelength band is within the range of from about 40% to 50% of the total energy from the lamp. In a preferred embodiment, the energy within the second and third wavelength bands is within the range of from about 25% to 35% and 20% to 30% of the total energy from the lamp, respectively.

A phosphor coating is prepared in a conventional manner by dispersing the phosphor particles in a water base system employing a binder such as polyethylene oxide and water. The phosphor suspension is applied in the usual manner of causing the suspension to flow down the inner surface of the bulb. The water is allowed to evaporate leaving the binder and phosphor particles adhered to the bulb wall.

Although the lamp depicted in FIGS. 1 and 2 is shown with a single phosphor layer disposed on the inner surface of the lamp envelope, it is well within the scope of the invention to have a different configuration. For example, the lamp may contain more than one phosphor layer or may contain one or more non-luminous layers, such as reflector or filter layers. The lamp may also include an aperture.

Figure 3:
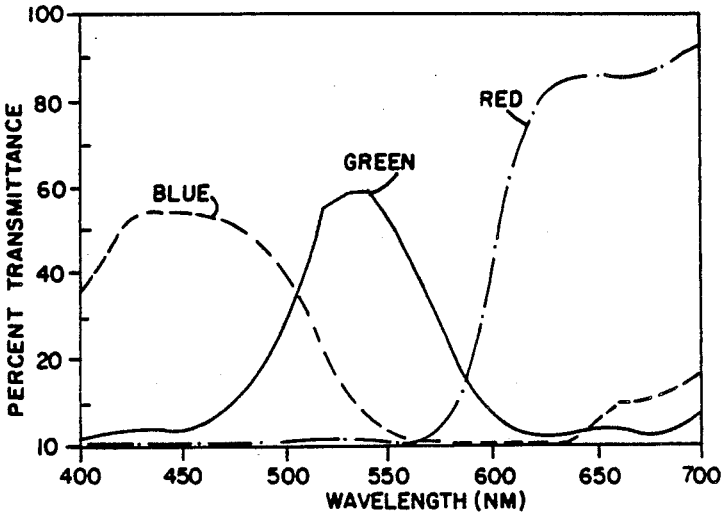
FIG. 3 is a graph depicting the transmission characteristics of typical liquid crystal color filters.

As previously stated, a lamp made in accordance with the invention is particularly well-suited to be used in conjunction with liquid crystal color filters to form the liquid crystal color display unit. Such filters are available, for example, from Brewer Science, Inc in Rolla, Mo. and have transmission characteristics as depicted in the graph of FIG. 3.

In a first non-limitative example of a fluorescent lamp in accordance with the teachings of the present invention, the fluorescent lamp is an F6T5 type having a nominal envelope diameter of ⅝ inch and a longitudinal length (excluding the base pins) of approximately 8.35 inches. The envelope contains a fill of argon at a pressure of approximately 3.8–4.6 torr. A phosphor mixture of about 43% by weight europium-activated strontium chlorophosphate, about 27% by weight cerium-terbium-activated magnesium aluminate, and about 30% by weight europium-activated yttrium oxide is disposed on the inner surface of the lamp envelope.

Figure 4:
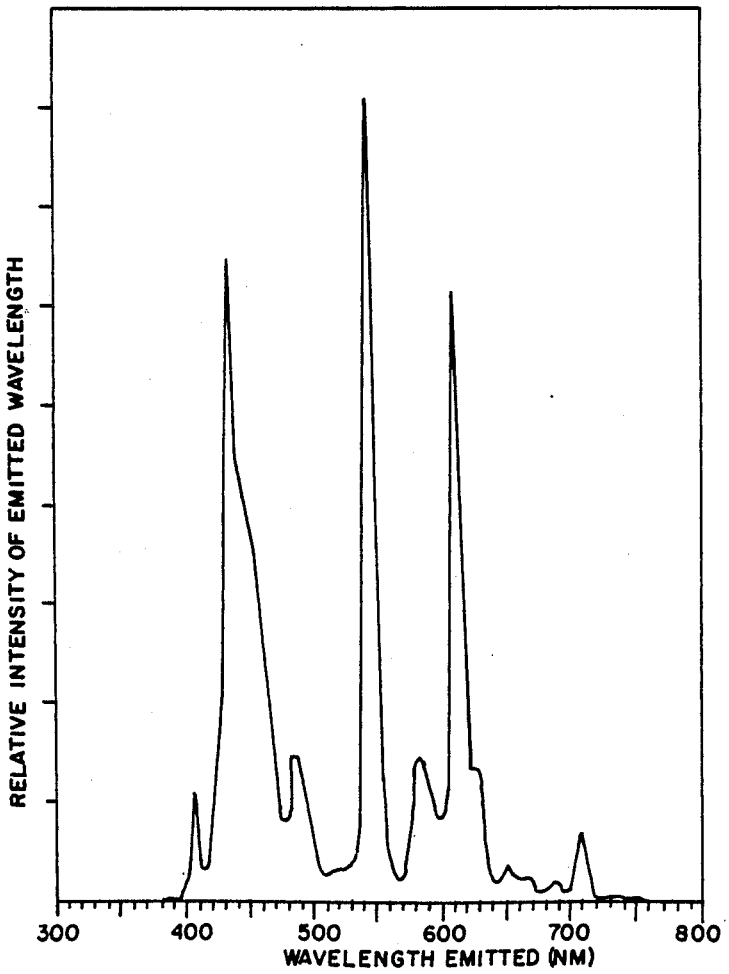
FIG. 4 is a graph depicting the spectral energy distribution of ,a lamp made in accordance with the teachings of present invention.

FIG. 4 is a graph depicting the spectral energy distribution between about 395 nanometers and 760 nanometers for the above lamp. As illustrated in FIG. 4 a first energy peak is located at 435 nanometers and has a bandwidth of about 28 nanometers as measured at an intensity which is 50% of the maximum intensity. A second energy peak, located at 545 nanometers, has a bandwidth of about 10 nanometers. A third energy peak is located at 611 nanometers and has a bandwidth of about 10 nanometers. The maximum intensity value of the first peak is about 80% of the maximum intensity value of the second energy peak. Moreover, the maximum intensity value of the third peak is about 76% of the maximum intensity value of the second energy peak. The amount of energy between 380 nanometers to 500 nanometers is about 45% of the total. Between about 500 nanometers to 600 nanometers, the amount of energy is about 30% of the total. Finally, the amount of energy within the band from 600 nanometers to 760 nanometers is about 25% of the total.

In a second non-limitative example of a fluorescent lamp in accordance with the teachings of the present invention, the fluorescent lamp is an F6T5 type having a nominal envelope diameter of ⅝ inch and a longitudinal length (excluding the base pins) of approximately 8.35 inches. The envelope contains a fill of argon at a pressure of approximately 3.8–4.6 torr. A phosphor mixture of about 28% by weight europium-activated strontium chlorophosphate, about 50% by weight manganese-activated zinc orthosilicate, and about 22% by weight europium-activated yttrium oxide is disposed on the inner surface of the lamp envelope.

Figure 5:
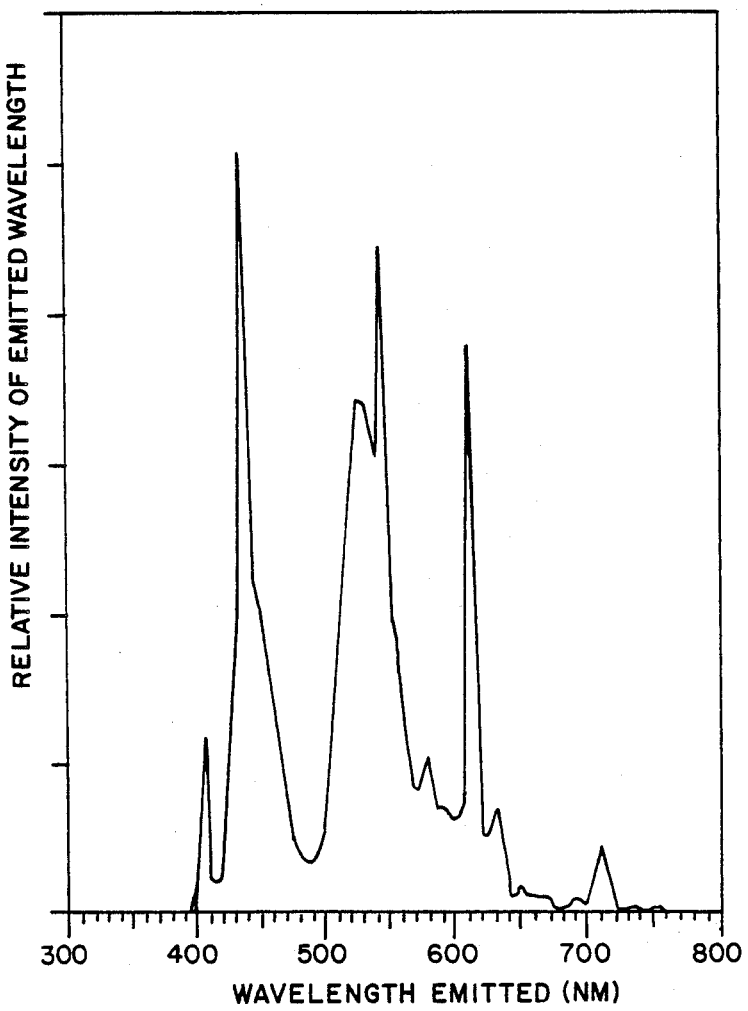
FIG. 5 is a graph depicting the spectral energy distribution of another lamp made in accordance with the teachings of the present invention.

FIG. 5 is a graph depicting the spectral energy distribution between about 395 nanometers and 760 nanometers for the above lamp. As illustrated in FIG. 5 a first energy peak is located at 438 nanometers and has a bandwidth of about 10 nanometers as measured at an intensity which is 50% of the maximum intensity. A second energy peak, located at 544 nanometers, has a bandwidth of about 40 nanometers. A third energy peak is located at 611 nanometers and has a bandwidth of about 10 nanometers. The maximum intensity value of the first peak is about 115% of the maximum intensity value of the second energy peak. Moreover, the maximum intensity value of the third peak is about 87% of the maximum intensity value of the second energy peak. Between about 380 nanometers to 500 nanometers, the amount of energy is about 31% of the total visible energy. The amount of energy between 500 nanometers to 600 nanometers is about 52% of the total visible energy. Between about 600 nanometers to 700 nanometers, the amount of energy is about 17% of the total visible energy.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A fluorescent lamp having energy located substantially within a first wavelength band between 400 nanometers and 500 nanometers, a second wavelength band between 500 nanometers and 600 nanometers, and a third wavelength band between 600 and 700 nanometers, said lamp comprising:

a light-transmissive glass envelope having a substantially circular configuration in cross-section;

an electrode operatively positioned proximate each end of said envelope;

an ionizable medium enclosed within said envelope and including an inert starting gas and a quantity of mercury, said ionizable medium when energized generating a plasma discharge comprising ultraviolet radiation and a limited proportion of visible radiation; and a phosphor means responsive to said ultraviolet radiation generated by the plasma discharge disposed within said envelope and comprising a mixture of different phosphors;

a first component of said phosphor mixture when energized by said ultraviolet radiation having a first energy peak with a predetermined maximum intensity located within a first wavelength range of from about 435 nanometers to 440 nanometers;

a second component of said phosphor mixture when energized by said ultraviolet radiation having a second energy peak with a predetermined maximum intensity located within a second wavelength range of from about 545 nanometers to 550 nanometers;

a third component of said phosphor mixture when energized by said ultraviolet radiation having a third energy peak with a predetermined maximum intensity located within a third wavelength range of from about 610 nanometers to 615 nanometers;

said maximum intensity of said first energy peak being within the range of from about 70% to 115% of said maximum intensity of said second energy peak, said maximum intensity of said third energy peak being within the range of from about 65% to 87% of said maximum intensity of said second energy peak, said first, second and third energy peaks having bandwidths less than or equal to about 40 nanometers as measured at an intensity which is 50% of a respective maximum intensity.

2. The fluorescent lamp of claim 1 wherein said maximum intensities of said first, second and third energy peaks are located respectively at 435 nanometers, 545 nanometers, and 611 nanometers.

3. The fluorescent lamp of claim 1 wherein the energy within said first wavelength band is within the range of from about 40% to 50% of the total energy from said lamp.

4. The fluorescent lamp of claim 3 wherein the energy within said second wavelength band is within the range of from about 25% to 30% of the total energy from said lamp.

5. The fluorescent lamp of claim 4 wherein the energy within said third wavelength band is within the range of from about 20% to 30% of the total energy from said lamp.

6. The fluorescent lamp of claim 1 wherein said phosphor means comprises a phosphor blend including predetermined proportions of at least europium-activated strontium chlorophosphate, cerium-terbium-activated magnesium aluminate, and europium-activated yttrium oxide.

7. The fluorescent lamp of claim 1 wherein said phosphor means comprises a phosphor blend including about 42% to 44% by weight europium-activated strontium chlorophosphate, about 25% to 29% by weight cerium-terbium-activated magnesium aluminate, and about 27% to 33% by weight europium-activated yttrium oxide.

8. The fluorescent lamp of claim 7 wherein said phosphor blend includes about 43% by weight europium-activated strontium chlorophosphate, 27% by weight cerium-terbium-activated magnesium aluminate, and about 30% by weight europium-activated yttrium oxide.

9. The fluorescent lamp of claim 1 wherein said phosphor means comprises a phosphor blend including predetermined proportions of at least europium-activated strontium chlorophosphate, manganese-activated zinc orthosilicate, and europium-activated yttrium oxide.

10. The fluorescent lamp of claim 9 wherein said phosphor means comprises a phosphor blend including about 28% by weight europium-activated strontium chlorophosphate, about 50% by weight manganese-activated zinc orthosilicate, and about 22% by weight europium-activated yttrium oxide.

* * * * *